US011377333B2

(12) United States Patent
Hollowell

(10) Patent No.: US 11,377,333 B2
(45) Date of Patent: Jul. 5, 2022

(54) END EFFECTORS AND METHODS OF RAISING AND LOWERING VEHICLE COMPONENTS USING END EFFECTORS

(71) Applicant: Toyota Motor Engineering & Manufacturing North America, Inc., Plano, TX (US)

(72) Inventor: Mary C. Hollowell, Marion, TX (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 0 days.

(21) Appl. No.: 16/552,528

(22) Filed: Aug. 27, 2019

(65) Prior Publication Data

US 2021/0061630 A1 Mar. 4, 2021

(51) Int. Cl.
*B66F 9/075* (2006.01)

(52) U.S. Cl.
CPC ..... *B66F 9/075* (2013.01)

(58) Field of Classification Search
CPC ..... B66C 7/02; B66C 7/16; B66C 7/18; B66F 9/141; B66F 9/075; B61B 13/04; B61B 13/06; F16C 29/02; F16C 29/068; F16C 29/0692
See application file for complete search history.

(56) References Cited

U.S. PATENT DOCUMENTS 4,106,641 A * 8/1978 Campbell ..... B66C 5/04 212/307
4,252,063 A * 2/1981 Brooks, Jr. ..... A61H 3/008 104/307
4,276,952 A * 7/1981 Kuhfuss, Jr. ..... B60K 5/10 180/294
4,576,096 A * 3/1986 Toder ..... B61H 7/04 188/42
4,899,985 A * 2/1990 Good ..... B66F 5/04 254/8 B
5,531,337 A 7/1996 Cappelletti et al.
5,632,589 A * 5/1997 Bray ..... B61C 11/04 198/349.6
9,498,887 B1 11/2016 Zevenbergen et al.
10,228,020 B1 * 3/2019 Burns ..... F16C 29/0697
2013/0327591 A1 * 12/2013 Galpin ..... A62B 35/0043 182/3

FOREIGN PATENT DOCUMENTS

CN 106541395 A 3/2017
CN 106393105 B 11/2018

* cited by examiner

*Primary Examiner* — Saul Rodriguez
*Assistant Examiner* — Brendan P Tighe
(74) *Attorney, Agent, or Firm* — Dinsmore & Shohl LLP

(57) ABSTRACT

An end effector includes an elongated body that is non-circular in cross section. A guide rail is mounted on a top surface of the elongated body. A hook carriage includes a linear motion guide that moves linearly along the guide rail to position a hook member. A locking mechanism locks the hook carriage at a preselected position along a length of the guide rail.

18 Claims, 5 Drawing Sheets

END EFFECTORS AND METHODS OF RAISING AND LOWERING VEHICLE COMPONENTS USING END EFFECTORS

TECHNICAL FIELD

The present specification generally relates to end effectors and associated methods, and more specifically, transmission pick end effectors with locking mechanisms for locking one or more support locations in place.

BACKGROUND

End effectors are frequently used to hook chains and parts together for a lifting operation. One such lifting operation is lifting transmissions from one assembly process to the next. Some end effectors may have false lifting points, which can lead to unintended unlatching and unsuccessful lifting operations. The shape of transmissions are generally elongated and asymmetric. Further the shapes and weight distributions from transmission type to transmission type can vary substantially. Accordingly, a need exists for transmission pick end effectors that include multiple support locations that are adjustable for different transmission types and can lock in place to reliably hold the transmissions.

SUMMARY

In one embodiment, an end effector includes an elongated body that is non-circular in cross section. A guide rail is mounted on a top surface of the elongated body. A hook carriage includes a linear motion guide that moves linearly along the guide rail to position a hook member. A locking mechanism locks the hook carriage at a preselected position along a length of the guide rail.

In another embodiment, a method of lifting a transmission using an end effector is provided. The method includes inserting a pin assembly into a bolt opening at a front portion of a transmission housing. A position of a hook carriage is adjusted along a length of a guide rail that is mounted on a top surface of an elongated body. The position of the hook carriage is locked. A rear portion of the transmission housing is engaged with a hook member that is pivotally connected to the hook carriage.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

The present description is generally directed to transmission pick end effectors with locking mechanisms for locking support locations in place after moving them to a desired location. The transmission pick end effectors include an elongated body that is non-circular in cross section (e.g., rectangular) in the form of a rod that includes a guide rail mounted on a top of the elongated body. The guide rail may be rectangular in cross-section including a flat top surface and a flat bottom surface. The guide rail may be part of a linear bearing assembly that further includes one or more linear motion guides. The linear motion guides can include bearings that ride along tracks that are provided by the guide rail. One linear motion guide may be provided as part of a hook carriage that moves linearly along the guide rail between preselected positions. The hook carriage may carry a hook member that hangs from the hook carriage and provides a first support location. Another linear motion guide may be provided as part of a chain carriage that also moves linearly along the guide rail between preselected positions. The chain carriage may include connecting structure that connects to a chain or other suitable linkage, such as from a hoist, to lift, hold and lower the transmission pick end effector. Both the hook carriage and the chain carriage may utilize locking mechanisms for locking them in their preselected locations along a length of the guide rail.

Figure 1:
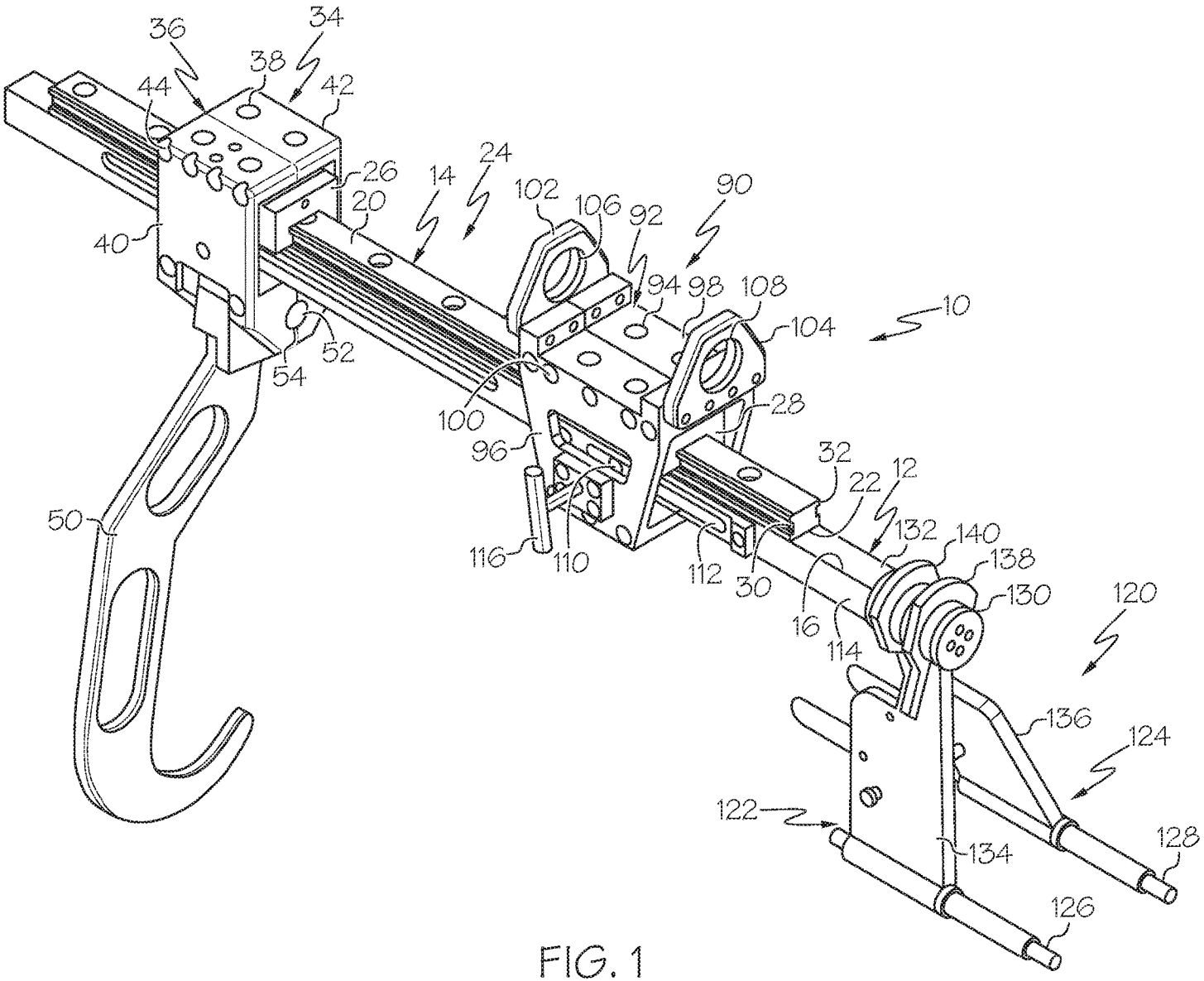
FIG. 1 is a side perspective view of a transmission pick end effector, according to one or more embodiments shown and described herein.

Referring to FIG. 1, a transmission pick end effector 10 includes an elongated body 12 in the form of a rod. In the illustrated example, the elongated body 12 is rectangular in cross-section and has a length that is much greater than its width, such as five times greater or more (e.g., 10 times greater or more, 15 times greater or more, 20 times greater or more, etc.). While a rectangular cross-section is illustrated for the elongated body 12, other non-circular cross-sections may be used. A guide rail 14 is mounted on a top surface 16 of the elongated body 12. For example, fasteners may be used to mount the guide rail 14 through openings 18 to the elongated body 12. The guide rail 14 may also be rectangular in cross-section including a flat top surface 20 and a flat bottom surface 22 that mates with the top surface 16 of the elongated body 12. The guide rail 14 may also have a length that is much greater than its width, such as five times greater or more (e.g., 10 times greater or more, 15 times greater or more, 20 times greater or more, etc.). While a rectangular cross section is illustrated for the guide rail 14, other non-circular cross-sections may be possible.

The guide rail 14 may be part of a linear bearing assembly, generally represented by element 24, that further includes linear motion guides 26 and 28. The linear motion guides 26 and 28 facilitate motion along the guide rail 14. For example, the linear motion guides 26 and 28 may include bearings that ride along tracks 30 and 32 that are provided in the guide rail 14. One linear motion guide 26 may be provided as part of a hook carriage 34. The hook carriage 34 may further include a housing 36 that connects to the linear motion guide 26, e.g., using fasteners that mount through openings 38. As can be seen, the housing 36 is formed by two C-shaped housing portions 40 and 42 that are connected to the linear motion guide 26 in a side-by-side fashion. The housing portions may also be connected directly to each other, e.g., using fasteners through openings 44.

The housing 36 carries a hook member 50 as a rear transmission engagement structure that is pivotally connected to the housing 36 at a pivot location 52. The pivot location 52 may be formed by a bolt or pin that extends through an opening 54 that is formed by both of the housing portions 40 and 42 under the elongated body 12. As will be described in greater detail below, the hook carriage 34 can be positioned along the guide rail 14 so that the hook member 50 can engage a rear portion of a transmission housing.

Figure 2:
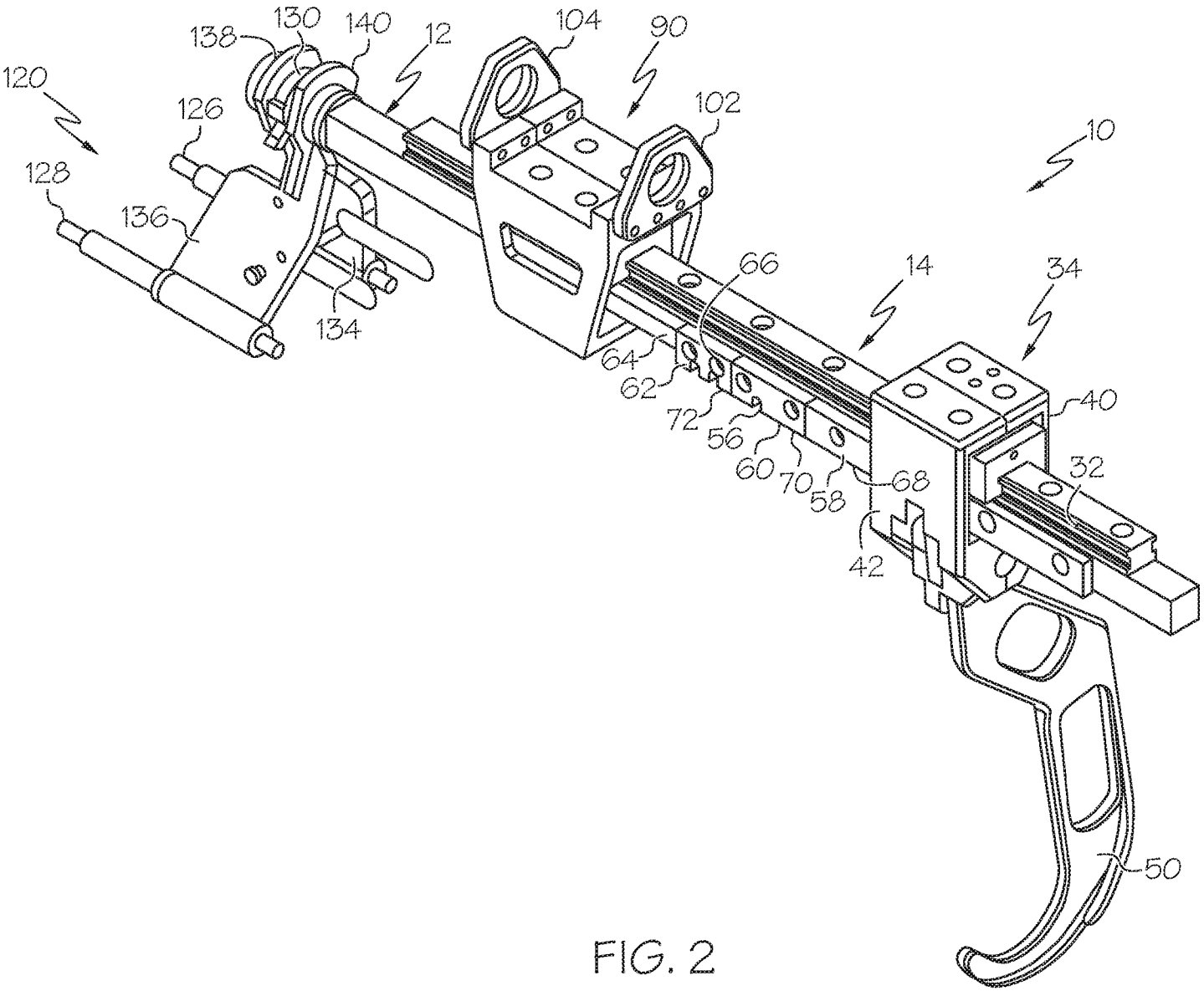
FIG. 2 is another side perspective view of the transmission pick end effector of FIG. 1, according to one or more embodiments shown and described herein.
Figure 3:
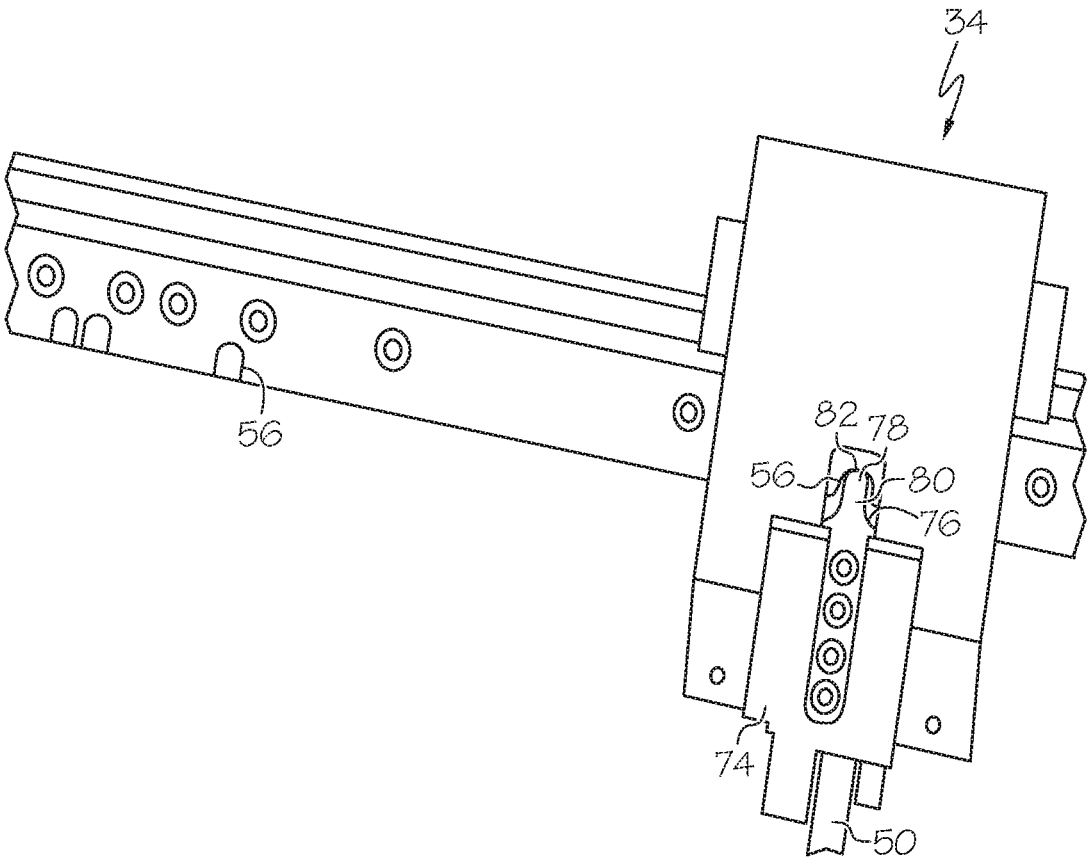
FIG. 3 is a detail view of a hook carriage in a locked configuration, according to one or more embodiments shown and described herein.

Referring also to FIGS. 2 and 3, the hook carriage 34 can be positioned along the guide rail 14 at predetermined positions that are defined by lock openings 56. The lock openings 56 are formed in one or more side rail members 58, 60 and 62 that are mounted on a side 64 of the elongated body 12, e.g., using fasteners that mount through openings 66. The lock openings 56 may be formed as notches that are formed in the side rail members 58, 60 and 62 and that intersect bottom edges 68, 70 and 72 of the side rail members 58, 60 and 62.

Figure 4:
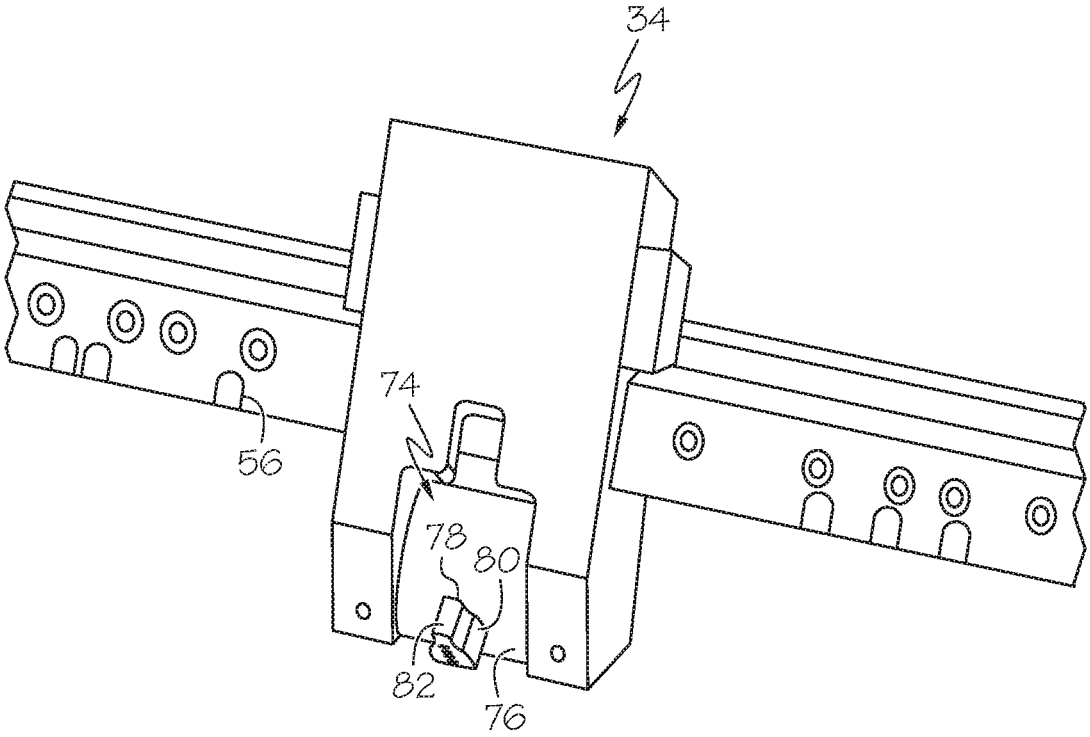
FIG. 4 is another detail view of the hook carriage of FIG. 3 in an unlocked configuration, according to one or more embodiments shown and described herein.

Referring particularly to FIG. 3 and also to FIG. 4, the hook member 50 is mounted to a pivot member 74 that is pivotally connected to the housing 36. The pivot member 74 includes an upper surface 76 to which a locking pin 78 is mounted. The locking pin 78 includes a stem portion 80 that extends outwardly from the upper surface 76 and a pin portion 82 that extends outwardly from the stem portion 80. The pin portion 82 provides a locking mechanism that is sized to be received within the lock openings 56 when the pivot member 74 and hook member 50 are in a lowered configuration, represented diagrammatically by FIG. 3. Because the center of gravity of the hook member 50 is below the pivot location 52 when in use, the hook member and the pivot member 74 are biased toward the lowered configuration by gravity. Rotation of the hook member 50 and the pivot member 74 into a raised configuration removes the pin portion 82 from the lock opening 56 and allows for linear movement of the hook carriage 34 from one position along the guide rail 14 to another position (e.g., to accommodate a different type of transmission).

Referring again to FIG. 1, another linear motion guide 28 may be provided as part of a chain carriage 90. The chain carriage 90 may further include a housing 92 that connects to the linear motion guide 26, e.g., using fasteners that mount through openings 94. As can be seen, the housing 92 is formed by two C-shaped housing portions 96 and 98 that are connected to the linear motion guide 26 in a side-by-side fashion. The housing portions 96 and 98 may also be connected directly to each other, e.g., using fasteners through openings 100.

The housing 92 carries connecting members 102 and 104 that extend outward from the housing portions 96 and 98. The connecting members 102 and 104 each include an opening 106 and 108 that are used to connect to a chain for lifting, supporting and lowering the transmission pick end effector 10 with a transmission connected thereto. The chain carriage 90 can be positioned along the guide rail 14 at predetermined positions that are defined by lock openings 110. The lock openings 110 are formed in one or more side rail members 112 that are mounted on a side 114 of the elongated body 12, e.g., using fasteners that mount through openings 114. A pin connector 116 may be provided that can be inserted through the housing 92 and into the lock openings 110. The lock opening 110 positions may correspond to a center of gravity of the transmission pick end effector 10 with a certain type of transmission connected thereto so that the transmission is supported in a horizontal orientation, for example, for installation to a motor.

Referring again to FIG. 1, the transmission pick end effector 10 further includes a front transmission engagement structure 120 including a pair of pin assemblies 122 and 124. The pin assemblies 122 and 124 include pins 126 and 128 that are connected to a round bar 130 that extends from a front 132 of the elongated body 12. In some embodiments, the bar 130 may be part of the elongated body 12 and formed monolithic therewith. In other embodiments, the bar 130 may be formed separately from the elongated body 12 and connected thereto. The pin assemblies 122 and 124 include arms 134 and 136 that are connected to the bar 130 by hangers 138 and 140. In some embodiments, one of the arms 134 and 136 may rotate around the bar 130 while the other of the arms 134 and 136 may be stationary or fixed to the bar 130. Rotating the arm 134, 136 can adjust the distance and position between pins 142 and 144 to accommodate transmissions of different types. The pins 142 and 144 are sized to be received within bolt holes of a bell housing portion of the transmission housing.

Figure 5:
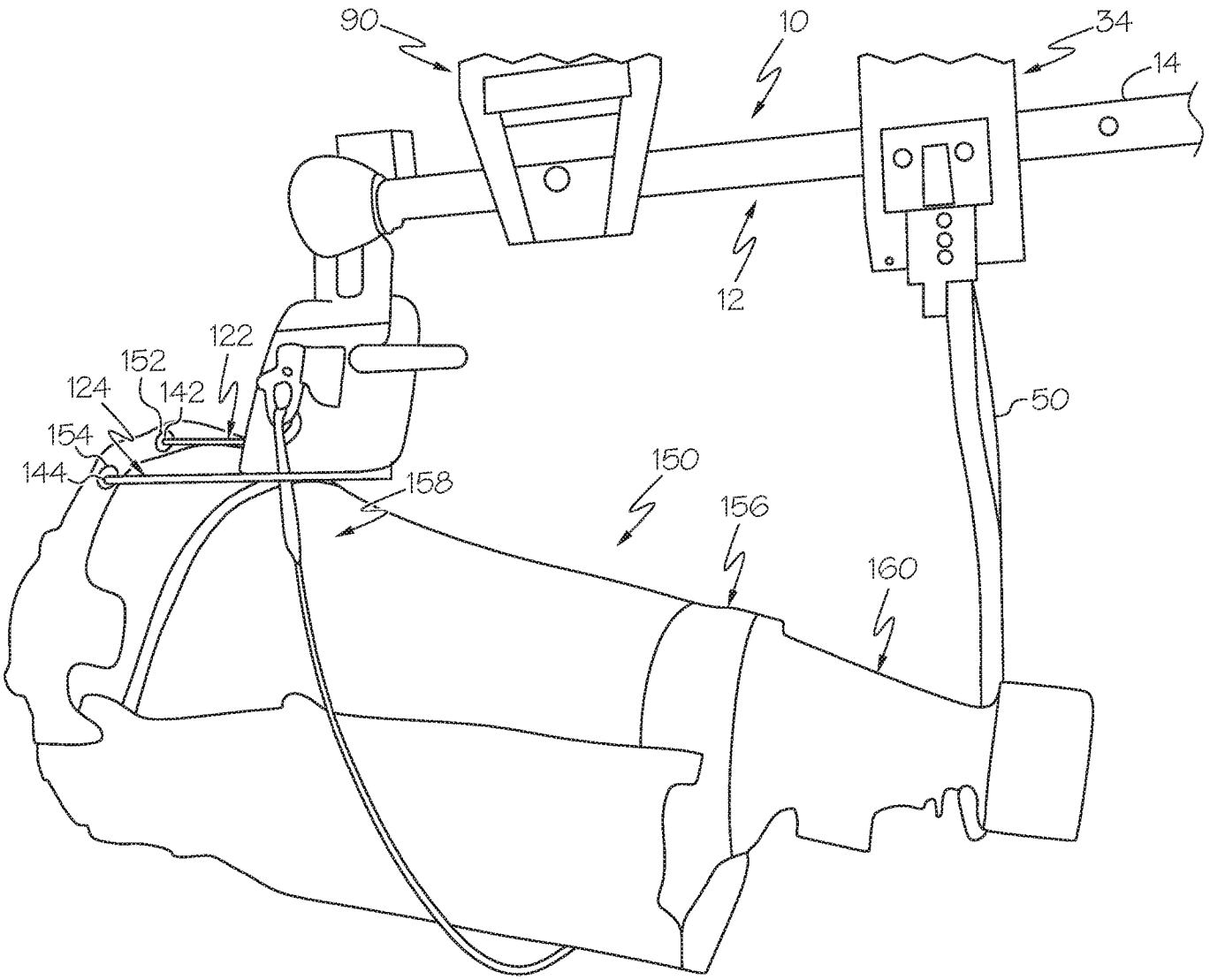
FIG. 5 is a diagrammatic illustration of a transmission pick end effector in use lifting a transmission, according to one or more embodiments shown and described herein.

Referring to FIG. 5, the transmission pick end effector 10 is illustrated supporting a transmission 150. Knowing the type of transmission (e.g., V8 4×4, V8 2×4, V6 4×4, V6 4×2, L4 4×2) a position of the chain carriage 90 may be adjusted along the length of the guide rail 14 and locked into a preselected position using the pin connector 116. The chain carriage 90 may be connected to chains that are connected to a hoist. In some embodiments, a position of the hook carriage 34 may also be adjusted along the length of the guide rail 14 by rotating the hook member 50 to unlock the hook carriage 34, sliding the hook carriage to a preselected location and then lowing the hook member 50 such that the locking pin 78 engages one of the lock openings 56 and locks the hook carriage 34 in place. In some embodiments, a position of one of the pin assemblies 122, 124 may be adjusted relative to the other of the pin assemblies 122, 124 by rotating the pin assembly 122, 124 about the bar 130. The pins 142 and 144 may then be inserted into the bolt openings 152 and 154 of a front portion 158 of transmission housing 156. The hook member 50 may be located under a rear portion 160 of the transmission housing 156. With the hook carriage 34 and the chain carriage 90 locked in place, the transmission 150 may be lifted using the transmission pick end effector 10. In some embodiments, with the transmission 150 lifted, the transmission 150 may be connected to an engine.

The split nature of the housings 36 and 92 into housing portions 40, 42 and 96, 98, respectively, provides the housing with a release prevention formation that inhibits unintended release of the housings 36 and 92 from the elongated body 16. In particular, should the rail 14 release from the elongated body 16, the linear motion guides 26 and/or 28 release from the rail 14, or the housings 36 and/or 38 release from their respective linear motion guides 26 and/or 28, the closed structure provided by the C-shaped housing portions 40, 42 and 96, 98 will inhibit a complete release of the housings 36 and 92 from the elongated body 16. Further, the C-shape of the housing portions 40, 42 and 96, 98 facilitates both manufacturing and assembly of the housings 36 and 92 compared to, for example, an enclosed single piece housing.

The above-described transmission pick end effectors allow for engagement with a transmission housing of a transmission at multiple locations (front and rear) to lift, support and lower the transmission in a reliable fashion. The transmission pick end effectors include a hook carriage and a chain carriage that can be locked into place along a length of a guide rail to inhibit unintended movement of the hook carriage and the chain carriage. The hook carriage and the chain carriage are each formed using a housing that completely surrounds an elongated body of the transmission pick end effectors. The hook carriage carries a hook member that has a locking pin located thereon such that rotation of the hook member locks or unlocks the position of the hook carriage along the length of the guide rail.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. An end effector comprising:

an elongated body that is non-circular in cross section;

a guide rail mounted over an outer facing top surface of the elongated body, the guide rail being shorter in length than the elongated body and comprising a recessed track extending along opposite sides of the guide rail;

a hook carriage comprising a linear motion guide that moves linearly along the track of the guide rail to position a hook member, the hook carriage comprising a housing that completely surrounds the guide rail and elongated body, the housing is formed by a pair of separate housing portions that are connected together forming a divide; and a locking mechanism that locks the hook carriage at a preselected position along the length of the guide rail.

2. The end effector of claim 1, wherein the locking mechanism comprises a locking pin that is received within a locking opening positioned along a length of the elongated body.

3. The end effector of claim 2, wherein the locking opening is provided by a side rail member that is mounted on a side of the elongated body.

4. The end effector of claim 2 further comprising a hook member that is pivotally connected to the hook carriage.

5. The end effector of claim 4, wherein the locking pin is located on the hook member such that rotation of the hook member moves the locking pin into and out of the locking opening.

6. The end effector of claim 4, wherein the hook member is sized to engage a rear portion of a transmission housing.

7. The end effector of claim 1 further comprising a chain carriage comprising a linear motion guide that moves linearly along the length of the guide rail.

8. The end effector of claim 7 comprising a locking pin that locks the chain carriage at a preselected position along the guide rail.

9. The end effector of claim 1 further comprising a front transmission engagement structure comprising at least one pin assembly connected to the elongated body that is sized to be received within a bolt opening of a transmission housing.

10. The end effector of claim 1, wherein the housing comprises a pair of C-shaped housing portions that are connected to the linear motion guide.

11. A method of lifting a transmission using an end effector, the method comprising:

inserting a pin assembly into a bolt opening at a front portion of a transmission housing;

adjusting a position of a hook carriage along a length of a guide rail that is mounted over an outer facing top surface of an elongated body, the guide rail being shorter in length than the elongated body and comprising a recessed track extending along opposite sides of the guide rail, the hook carriage comprising a housing that completely surrounds the guide rail and elongated body the housing is formed by a pair of separate housing portions that are connected together forming a divide;

locking the position of the hook carriage; and engaging a rear portion of the transmission housing with a hook member that is pivotally connected to the hook carriage.

12. The method of claim 11, wherein a locking pin is located on the hook member such that rotating the hook member moves the locking pin into and out of a locking opening.

13. The method of claim 11 further comprising adjusting a position of a chain carriage along a length of the guide rail.

14. The method of claim 13 further comprising locking the position of the chain carriage.

15. The method of claim 14, wherein the step of locking the position of the chain carriage comprises inserting a pin connector through the chain carriage and into a locking opening.

16. The method of claim 11 further comprising adjusting a position of the pin assembly.

17. The method of claim 11 comprising inserting another pin assembly into another bolt opening at the front portion of the transmission housing.

18. The end effector of claim 7, wherein the track is spaced above the top surface of the elongated body such that the linear motion guide is located above the top surface of the elongated body.

* * * * *